US009410704B2

(12) United States Patent
Zhang et al.

(10) Patent No.: US 9,410,704 B2
(45) Date of Patent: Aug. 9, 2016

(54) ANNULAR STRIP MICRO-MIXERS FOR TURBOMACHINE COMBUSTOR

(71) Applicant: General Electric Company, Schenectady, NY (US)

(72) Inventors: Qingguo Zhang, Niskayuna, NY (US); Fei Han, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 555 days.

(21) Appl. No.: 13/908,156

(22) Filed: Jun. 3, 2013

(65) Prior Publication Data

US 2014/0352322 A1 Dec. 4, 2014

(51) Int. Cl.
*F23R 3/28* (2006.01)
*F23N 5/00* (2006.01)

(52) U.S. Cl.
CPC ..... *F23R 3/286* (2013.01); *F23N 5/003* (2013.01); *F23N 2025/08* (2013.01); *F23N 2041/20* (2013.01)

(58) Field of Classification Search
CPC ..... F23R 3/286; F23R 3/54; F23R 3/28; F23R 2900/00014; F23N 5/003; F23N 5/02; F23N 2025/08; F23N 2041/20
USPC ..... 60/733, 734, 737, 738, 739, 740, 746, 60/747, 758, 773
See application file for complete search history.

(56) References Cited

U.S. PATENT DOCUMENTS

| | | | | |
|---|---|---|---|---|
| 4,472,936 | A * | 9/1984 | Uchiyama | F02C 3/28 422/111 |
| 5,235,814 | A * | 8/1993 | Leonard | F23R 3/283 60/738 |
| 5,339,635 | A * | 8/1994 | Iwai | F23D 14/26 60/733 |
| 6,438,961 | B2 | 8/2002 | Tuthill et al. | |
| 6,810,655 | B2 | 11/2004 | Davis et al. | |
| 6,928,823 | B2 * | 8/2005 | Inoue | F02C 7/22 60/737 |
| 7,093,445 | B2 | 8/2006 | Corr, II et al. | |
| 7,117,676 | B2 * | 10/2006 | Farhangi | F23L 15/04 60/736 |
| 7,624,576 | B2 | 12/2009 | Alkabie et al. | |
| 7,654,092 | B2 | 2/2010 | Ryan et al. | |
| 7,997,083 | B2 | 8/2011 | Meadows et al. | |
| 8,234,871 | B2 | 8/2012 | Davis et al. | |
| 2008/0268387 | A1 * | 10/2008 | Saito | F23R 3/286 431/8 |
| 2010/0186413 | A1 * | 7/2010 | Lacy | F23R 3/10 60/740 |
| 2010/0218501 | A1 * | 9/2010 | York | F23R 3/286 60/737 |
| 2010/0293955 | A1 | 11/2010 | Berry et al. | |
| 2011/0225947 | A1 | 9/2011 | Lacy et al. | |
| 2013/0014514 | A1 | 1/2013 | Romig et al. | |

* cited by examiner

*Primary Examiner* — Steven Sutherland
(74) *Attorney, Agent, or Firm* — Ann M. Agosti

(57) ABSTRACT

A turbomachine combustor is provided. The turbomachine includes a combustion chamber and multiple micro-mixer nozzles arranged concentrically within a radial combustion liner and configured to receive fuel from one or more fuel supply pipes affixed to each of the plurality of micro-mixer nozzles at an upstream face. The multiple micro-mixer nozzle are also configured to receive air from a flow sleeve surrounding the radial combustion liner. Each of the micro-mixer nozzles include an annular strip having a multiple tubes or passages extending axially from the upstream face to a downstream face of each of the micro-mixer nozzles.

10 Claims, 4 Drawing Sheets

ANNULAR STRIP MICRO-MIXERS FOR TURBOMACHINE COMBUSTOR

BACKGROUND

The present application relates generally to gas turbine combustion technology and, more specifically, to a fuel injection micro-mixer nozzle arrangement for a turbomachine combustor.

Combustion instability/dynamics is a phenomenon in turbomachines, especially those utilize lean pre-mixed combustion system. Low frequency combustion dynamics is typically excited as axial modes, whereas high frequency dynamics as radial, azimuthal and axial modes by the combustion process commonly referred to as "screech". Combustion dynamics can affect all combustor components, even the parts upstream and downstream. Under certain operating conditions, the combustion component and the acoustic component couple to create a very high pressure fluctuation inside the combustors that has a negative impact on various turbomachine components with a potential for hardware damage. More specifically, fluctuations in the fuel-air ratio are known to cause combustion dynamics that lead to combustion instability. Creating perturbations in the fuel-air mixture by changing fuel flow rate can disengage the combustion field from the acoustic field to suppress combustion instability.

Further, the combustor may be affected by non-uniform temperature profile and non-uniform mixing of fuel and air across the combustor region, thereby, negatively impacting the performance and efficiency of the turbomachine combustor.

There is therefore a desire for a system and method that improves air uniformity of micro-mixer nozzles and reduce amplitudes of combustion dynamics in the combustor which would be useful to enhancing the thermodynamic efficiency of the combustor, protecting the combustor from catastrophic damage, and/or reducing undesirable emissions over a wide range of combustor operating levels.

BRIEF DESCRIPTION

In accordance with an embodiment of the invention, a turbomachine combustor is provided. The turbomachine includes a combustion chamber and multiple micro-mixer nozzles arranged concentrically within a radial combustion liner and configured to receive fuel from one or more fuel supply pipes affixed to each of the plurality of micro-mixer nozzles at an upstream face. The multiple micro-mixer nozzles are also configured to receive air from a flow sleeve surrounding the radial combustion liner. Each of the micro-mixer nozzles include an annular strip having a multiple tubes or passages extending axially from the upstream face to a downstream face of each of the micro-mixer nozzles.

In accordance with an embodiment of the invention, a method of combusting fuel is provided. The method includes arranging multiple micro-mixer nozzles concentrically within a radial combustion liner of a turbomachine combustor, wherein each of the multiple micro-mixer nozzles includes an annular strip having multiple tubes or passages extending axially from an upstream face to a downstream face of each of the micro-mixer nozzles. The method also includes directing a compressed air into the multiple micro-mixer nozzles from a flow sleeve surrounding the radial combustion liner at the upstream face. Further, the method includes supplying fuel to each of the multiple micro-mixer nozzles from a corresponding fuel supply circuit at the upstream face into the multiple tubes or passages for pre-mixing with the fuel.

In accordance with an embodiment of the invention, a system for operating a turbomachine combustor is provided. The system includes a combustion chamber of a gas turbine. The system also includes multiple micro-mixer nozzles arranged concentrically within a radial combustion liner and configured to receive fuel and air from one or more fuel supply pipes affixed to each of the multiple micro-mixer nozzles at an upstream face and a flow sleeve surrounding the radial combustion liner respectively, wherein the multiple micro-mixer nozzles are arranged in parallel with different axial length dimensions for mitigating low frequency dynamics within the combustion chamber. Each of the multiple micro-mixer nozzles includes an annular strip having multiple tubes or passages extending axially from the upstream face to a downstream face of each of the micro-mixer nozzles.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters are not exclusive of other parameters of the disclosed embodiments.

Figure 1:
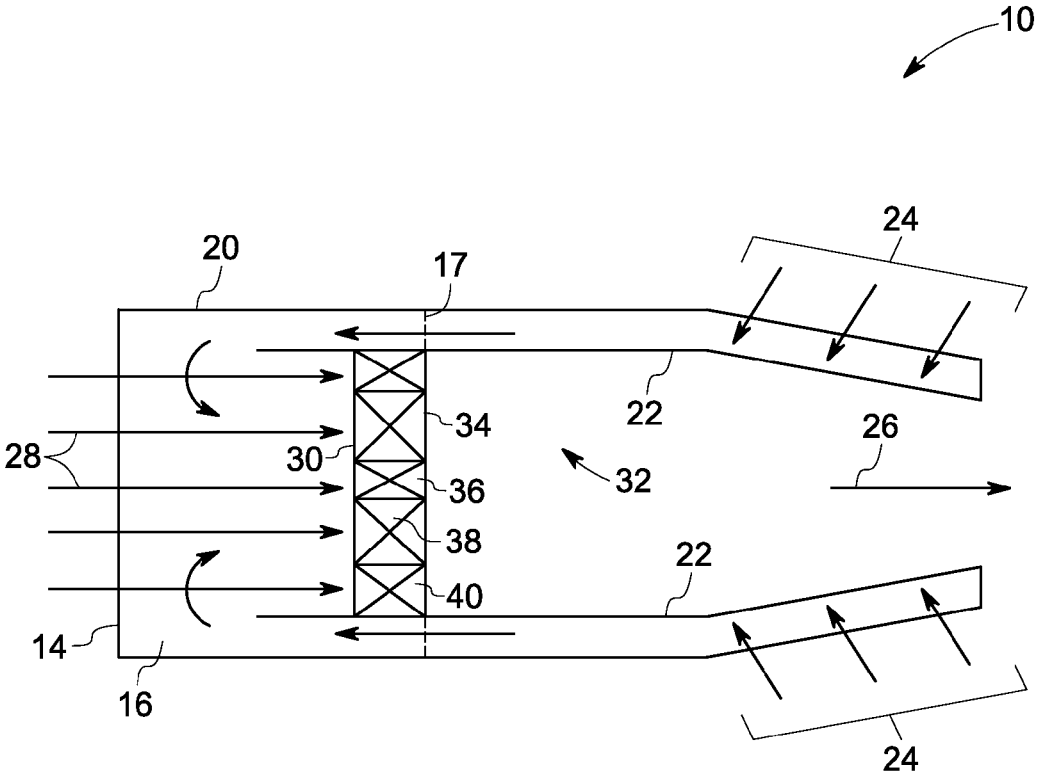
FIG. 1 is a schematic view of a turbomachine combustor having multiple micro-mixer nozzles in accordance with an embodiment of the present invention.

FIG. 1 is a schematic view of a turbomachine combustor 10 having a plurality of micro-mixer nozzles 12 in accordance with an embodiment of the present invention. In one embodiment, the turbomachine combustor 10 is a part of a gas turbine. As shown, the turbomachine combustor 10 includes an end wall 14 that supports the multiple micro-mixer nozzles 12 extending through a chamber 16 between the end wall 14 and an aft cap assembly 17. A flow sleeve 20 surrounds a combustor liner 22 and provides a path for compressor air 24 to flow in a direction opposite to a flow of combustion gases 26 through the turbomachine combustor 10. The compressed air 24 flows from the flow sleeve 20 and takes a U-turn prior to entering the multiple micro-mixer nozzles 12. In this embodiment, the multiple micro-mixer nozzles 12 are arranged concentrically within the radial combustion liner 22 and configured to receive fuel from one or more fuel supply pipes 28 affixed to each of the multiple micro-mixer nozzles 12 at an upstream face 30.

In the micro-mixer nozzles 12, the fuel mixes with air 24 as described further herein, and is then injected into the combustion chamber 32 where the fuel/air is burned and then supplied in gaseous form to a turbine first stage. The multiple micro-mixer nozzles 12 are also supported at their aft ends by the aft cap assembly 17.

It is to be noted that a plurality of turbomachine combustors 10 are typically arranged to supply a mixture of fuel and air to the respective combustion chambers. In a known turbine configuration, an annular array of such combustors (often referred to as a "can-annular" array) supply combustion gases to a first stage of the turbine by means of a like number of transition pieces or ducts.

Each of the multiple micro-mixer nozzles 12 includes an annular strip having a plurality of tubes or passages (not shown) extending axially from the upstream face 30 to a downstream face 34 of each of the micro-mixer nozzles 12. As shown in the embodiment in FIG. 1, the multiple micro-mixer nozzles 12 includes a center micro-mixer nozzle 36 and a first annular micro-mixer nozzle 38 surrounding the center micro-mixer nozzle 36. The multiple micro-mixer nozzles 12 include a second annular micro-mixer nozzle 40 surrounding the first micro-mixer nozzle 38 and the center micro-mixer nozzle 36.

Figure 2:
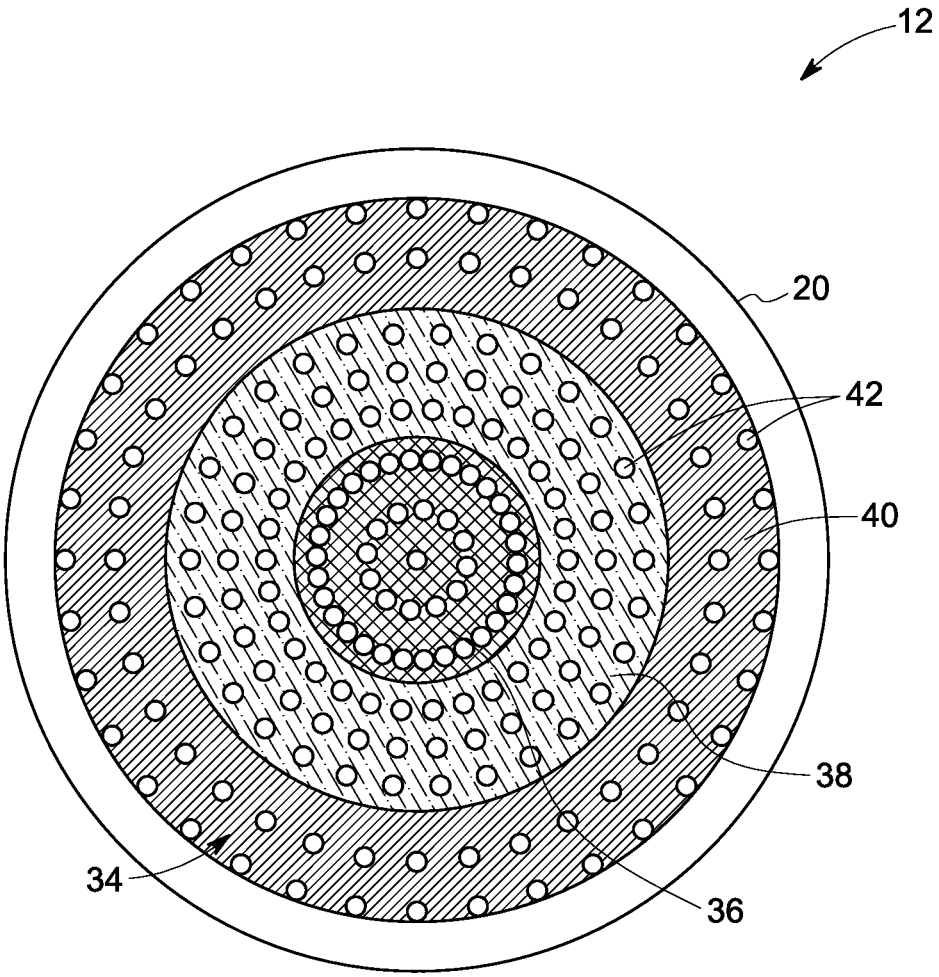
FIG. 2 is a schematic aft-end view of the micro-mixer nozzles in a turbomachine combustor in accordance with the embodiment of the present invention.

FIG. 2 is a schematic aft-end view of the downstream face 34 of the micro-mixer nozzles 12 in the turbomachine combustor 10 (shown in FIG. 1) in accordance with the embodiment of the present invention. In the embodiment, the multiple micro-mixer nozzles 12 shows the center micro-mixer nozzle 36, the first annular micro-mixer nozzle 38 and the second annular micro-mixer nozzle 40 that are concentrically arranged. The flow sleeve 20 surrounds the outermost second annular micro-mixer nozzle 40 through which compressed air 24 (as shown in FIG. 1) is directed into the turbomachine combustor 10. Each of the micro-mixer nozzles 12 include the plurality of tubes or passages (shown as 43 in FIG. 3) that extends from the upstream face 30 and ends up at the downward face 34 in an array of openings or holes 42 that are arranged uniformly. In one embodiment, the array of openings 42 may be distributed non-uniformly at the downward face 34 such that the center micro-mixer nozzle 36 have higher concentration of openings 42 than the first annular micro-mixer nozzle 38 or the second annular micro-mixer nozzle 40. In another embodiment, the first annular micro-mixer nozzle 38 may include higher concentration of openings 42 than the center micro-mixer nozzle 36 and the second annular micro-mixer nozzle 40.

Figure 3:
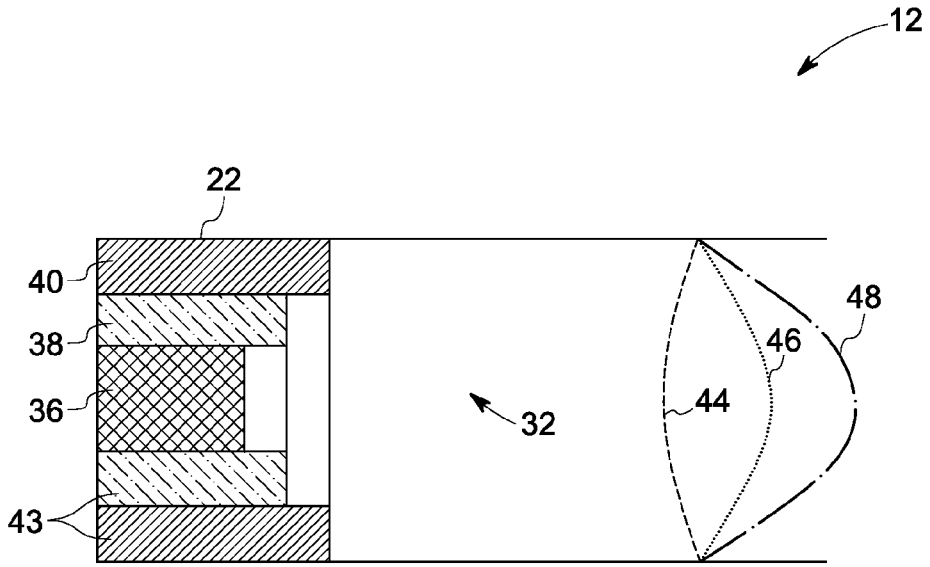
FIG. 3 is a side view of a micro-mixer nozzle located in a turbomachine combustor in accordance with an embodiment of the present invention.

FIG. 3 shows a side view of the micro-mixer nozzle 12 located in the turbomachine combustor 10 in accordance with an embodiment of the present invention. As shown, each of the micro-mixer nozzles 36, 38, 40 includes the plurality of tubes or passages 43. In this embodiment, each of the downstream face of the center micro-mixer nozzle 36, the first annular micro-mixer nozzle 38 and the second annular micro-mixer nozzle 40 are axially staggered with respect to each other due to different axial length of each of the plurality of micro-mixer nozzles. This axially staggered layout of the micro-mixer nozzles 36, 38, 40 significantly reduces the possibility of low frequency axial mode dynamics getting excited within the combustion chamber 32. In one embodiment, the first annular micro-mixer nozzle 38 comprises a first axial length dimension greater than a second annular axial length dimension of the second annular micro-mixer nozzle 40 and a third axial length dimension of the center micro-mixer nozzle 36. In this embodiment, the second axial length dimension of the second annular micro-mixer nozzle 40 is greater than the third axial length dimension of the center micro-mixer nozzle 36.

In another embodiment, the second axial length dimension of the second annular micro-mixer nozzle 40 is greater than the first axial length dimension of the first annular micro-mixer nozzle 38 and greater than the third axial length dimension of the center micro-mixer nozzle 36. In this embodiment, the first axial length dimension of the first annular micro-mixer nozzle 38 is greater than the third axial length dimension of the center micro-mixer nozzle 36. In one embodiment, the micro-mixer nozzles 36, 38, 40 are configured to be mechanically staggered axially for mitigating unusual frequency dynamics in the combustion chamber 32.

The flow of fuel in the center micro-mixer nozzle 36, the first annular micro-mixer nozzle 38 and the second annular micro-mixer nozzle 40 may be varied by controlling the flow of fuel in respective fuel supply pipes (shown as 28 in FIG. 1). This is done for maintaining a desired fuel/air ratio distribution, or temperature profile radially within the combustor chamber 32. In this embodiment, various adjustable temperature profiles 44, 46 and 48 are depicted in the combustor chamber 32 that may be generated for better cooling strategy of downstream turbine blades, controlling NOx emissions and maintaining good health of the combustor liner 22. In one embodiment, a first desired temperature profile 48 includes higher temperature towards the center compared to the periphery of the turbomachine combustor. In another embodiment, a second desired temperature profile 44 includes leaner temperature towards the center compared to the periphery of the turbomachine combustor. Further, due to flow path profile of air flowing from the flow sleeve 20 (shown in FIG. 1) into the micro-mixer nozzles 12 through a U-turn curve (shown in FIG. 1), there is higher air flow towards the center of the micro-mixer nozzles 12. This non-uniformity of air flow radially through the micro-mixer nozzles 12 causes non-uniform fuel-air ratio radially in the combustor chamber, thereby, further causing non-uniform flame generated within the combustor chamber 32, which has been known as a key contributor to high nitrogen oxide (NOx) emissions. Thus, controlling the fuel flow in each of the micro-mixer nozzles 12 causes the fuel-air ratio in the combustor chamber to be uniform, thereby leading to uniform flame generation in the combustion chamber 32 and further leads to reduction in nitrogen oxide (NOx) emissions. Due to the nature of the annular nozzle, one advantage of the uniform flame generation circumferentially is mitigation of high frequency dynamics in the combustor chamber 22 and thereby prevention of any damages of combustor components. In addition, the staggered faces of the micro-mixer nozzle 36, 38, and 40, can suppress low frequency axial model dynamics.

Figure 4:
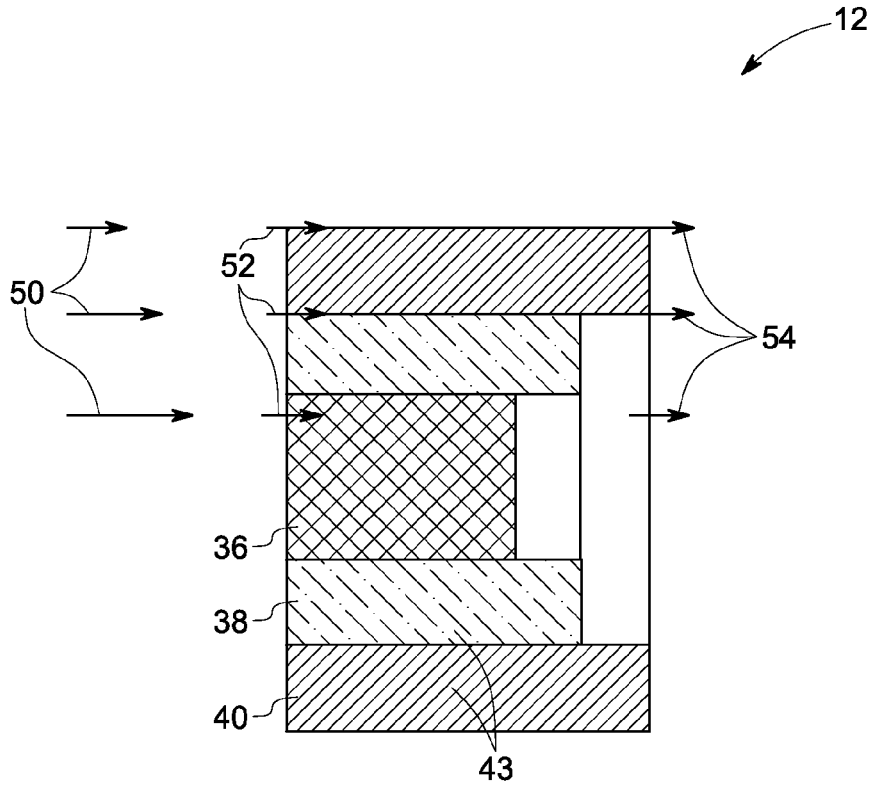
FIG. 4 is a side view of a micro-mixer nozzle showing variable flows of fuel and air in accordance with an embodiment of the present invention.

According to one embodiment as shown in FIG. 4, the micro-mixer nozzles 12 receives a variable flow of air 50 radially with a higher air flow towards the center due to flow path profile of air flowing from the flow sleeve 20 (shown in FIG. 1) into the micro-mixer nozzles 12. In this embodiment, a variable flow of fuel 52 is directed into the micro-mixer nozzles 12 such that the center micro-mixer nozzle 36 receives higher flow of fuel as compared to the flow of fuel into the first annular micro-mixer nozzle 38 and the second annular micro-mixer nozzle 40. This causes a uniform fuel-air mixture radially and circumferentially within the combustor chamber 32 due to mixing of variable flow of air 50 and the variable flow of fuel 52 within the multiple tubes or passages 43 of each of the micro-mixer nozzles 12.

Figure 5:
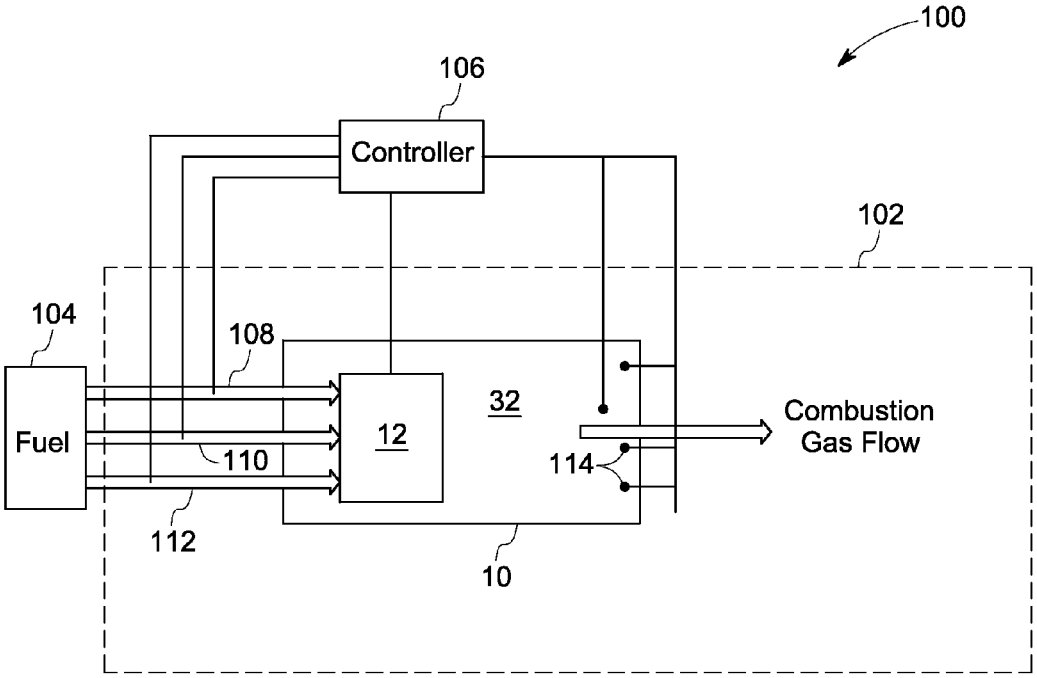
FIG. 5 is a schematic view of a system for operating a turbine combustor in accordance with an embodiment of the present invention.

FIG. 5 is a schematic view of a system 100 for operating the turbomachine combustor 10 in accordance with an embodiment of the present invention. As illustrated, the turbomachine combustor 10 is located in a gas turbine 102. The turbomachine combustor 10 includes the combustor chamber 32. The system 100 includes multiple micro-mixer nozzles 12 arranged concentrically (shown in FIG. 2 and FIG. 3) within a radial combustion liner of the turbomachine combustor 10. The multiple micro-mixer nozzles 12 are configured to receive fuel from a fuel source 104 from one or more fuel supply pipes affixed to each of the plurality of micro-mixer nozzles 12 at an upstream face 30 (shown in FIG. 1). The multiple micro-mixer nozzles 12 also receive air from a flow sleeve 20 (as shown in FIG. 1) surrounding the radial combustion liner 22 (as shown in FIG. 1) for premixing with the fuel before combusting in the combustor chamber 32. Each of the multiple micro-mixer nozzles 12 comprises an annular strip having a plurality of tubes or passages 43 (as shown in FIG. 1) extending axially from the upstream face to a downstream face of each of the micro-mixer nozzles 12. The system 100 includes a controller 106 that is configured to vary fuel supply in each of the plurality of micro-mixer nozzles 12 by controlling fuel flow in the corresponding fuel supply pipes 108, 110, 112 in response to temperature variation sensed by multiple sensors 114 in the combustion chamber 32. In a non-limiting manner, the multiple sensors 114 may be configured to sense multiple operating parameters such as temperature, pressure, NOx emissions, dynamics and vibrations.

In one embodiment, each of the multiple micro-mixer nozzles (shown as 36, 28, and 40 in FIG. 3) are arranged in parallel with different axial length dimensions for mitigating low frequency dynamics within the combustion chamber 32. The controller 106 may also be coupled to the micro-mixer nozzles 12 via a mechanism that may be configured to mechanically stagger each of the micro-mixer nozzles (shown as 36, 28, and 40 in FIG. 3) axially for mitigating low frequency axial mode dynamics detected by the sensors 114 in the combustion chamber 32.

Figure 6:
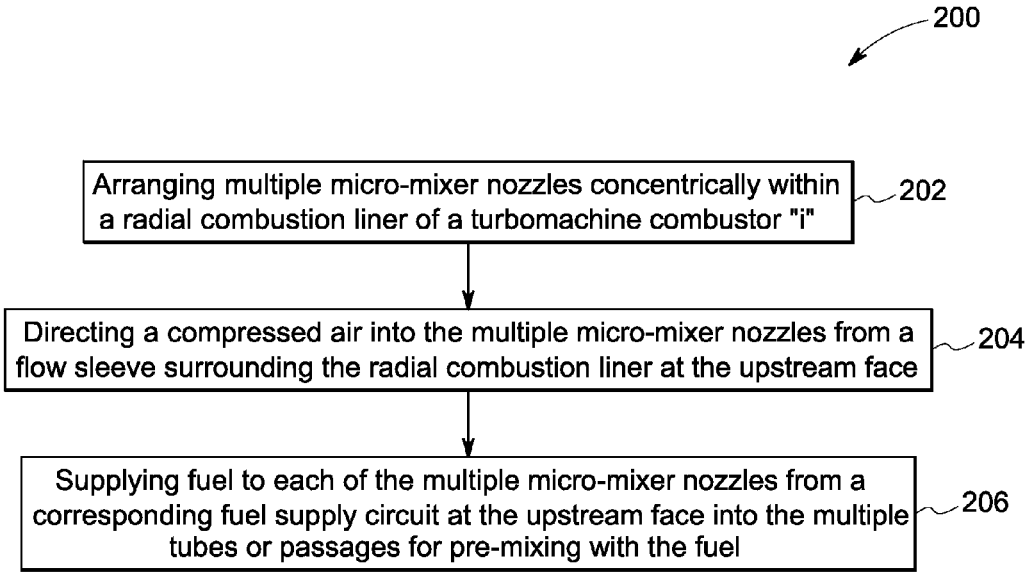
FIG. 6 is flow chart of a method of combusting fuel in a turbomachine combustor in accordance with an embodiment of the present invention.

FIG. 6 is flow chart of a method 200 of combusting fuel in a turbomachine combustor in accordance with an embodiment of the present invention. At step 202, the method 200 includes arranging multiple micro-mixer nozzles concentrically within a radial combustion liner of a turbomachine combustor. Each of the multiple micro-mixer nozzles includes an annular strip having multiple tubes or passages extending axially from an upstream face to a downstream face of each of the micro-mixer nozzles. At step 204, the method 200 includes directing a compressed air into the multiple micro-mixer nozzles from a flow sleeve surrounding the radial combustion liner at the upstream face. Further, at step 206, the method 200 includes supplying fuel to each of the multiple micro-mixer nozzles from a corresponding fuel supply circuit at the upstream face into the multiple tubes or passages for pre-mixing with the fuel. Furthermore, the method 200 includes arranging the plurality of micro-mixer nozzles in parallel having different axial length dimensions for mitigating low frequency dynamics within the combustion chamber. The method 200 includes varying fuel flow in each of the plurality of micro-mixer nozzles by controlling fuel flow in the corresponding fuel supply circuit. In one embodiment, the method 200 includes increasing a fuel flow in a center micro-mixer nozzle for increasing a fuel-air ratio that is comparable with fuel-air ratio in adjacent micro-mixer nozzles.

Advantageously, the present invention ensures a quieter, low emission turbomachine combustor with higher reliability. The controlling of the fuel flow in the micro-mixer nozzles of the turbomachine combustor ensures adjustable temperature profile at the exit of the combustor chamber of the gas turbine. Moreover, the present invention ensures improved fuel-air mixing and decreased NOx emissions due to the controlled temperature profile. Further, the present system comprising the turbomachine combustor and the method prevents high frequency dynamics due to uniform circumferential flame generation within the combustor chamber. Furthermore, the axially staggered micro-mixer nozzle layout significantly reduces the possibility to trigger low frequency dynamics. Also the second annular micro-mixer nozzle may be fired at relatively low temperature conditions for protecting the combustion liner.

Furthermore, the skilled artisan will recognize the interchangeability of various features from different embodiments. Similarly, the various method steps and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A turbomachine combustor comprising:

a combustion chamber;

a radial combustion liner at least partially surrounding the combustion chamber;

a flow sleeve at least partially surrounding the radial combustion liner;

a plurality of fuel supply pipes;

a plurality of annular micro-mixer nozzles arranged concentrically and each comprising a plurality of tubes or passages positioned to receive fuel from at least one of the plurality of fuel supply pipes and air from the flow sleeve at an upstream face and to provide a mixture of fuel and air to the combustion chamber at a downstream face; and a controller to vary flows of fuel into the plurality of annular micro-mixer nozzles, wherein a center micro-mixer nozzle of the plurality of annular micro-mixer nozzles receives a higher flow of fuel as compared to a flow of fuel into another one of the plurality of annular micro-mixer nozzles for increasing a fuel-air ratio in the center micro-mixer nozzle to a value that is comparable with a fuel-air ratio in the another one of the plurality of annular micro-mixer nozzles.

2. The turbomachine combustor of claim 1, wherein the plurality of annular micro-mixer nozzles are mounted to an end wall of the combustion chamber.

3. The turbomachine combustor of claim 1, wherein the plurality of tubes or passages located within the plurality of annular micro-mixer nozzles have an array of openings arranged uniformly at the downstream face.

4. The turbomachine combustor of claim 1, wherein the plurality of fuel supply pipes are configured to be adjustable for varying flow of fuel independently in each of the plurality of annular micro-mixer nozzles.

5. The turbomachine combustor of claim 1, wherein each of the downstream faces corresponding to the each of the plurality of the annular micro-mixer nozzles remain axially staggered with respect to each other due to different axial lengths of each of the plurality of annular micro-mixer nozzles.

6. The turbomachine combustor of claim 1, wherein the plurality of annular micro-mixer nozzles comprise a first annular micro-mixer nozzle surrounding the center micro-mixer nozzle.

7. The turbomachine combustor of claim 6, wherein the plurality of annular micro-mixer nozzles comprise a second annular micro-mixer nozzle surrounding the first micro-mixer nozzle and the center micro-mixer nozzle.

8. The turbomachine combustor of claim 7, wherein the first annular micro-mixer nozzle comprises a first axial length dimension less than a second axial length dimension of the second annular micro-mixer nozzle and greater than a third axial length dimension of the center micro-mixer nozzle.

9. A system for operating a turbomachine combustor, the system comprising:

a combustion chamber of a gas turbine;

a radial combustion liner at least partially surrounding the combustion chamber;

a flow sleeve at least partially surrounding the radial combustion liner;

a plurality of fuel supply pipes;

a plurality of annular micro-mixer nozzles arranged concentrically and each comprising a plurality of tubes or passages positioned to receive fuel and air from at least one of the plurality of fuel supply pipes and the flow sleeve surrounding the radial combustion liner respectively, wherein the plurality of annular micro-mixer nozzles are arranged in parallel with different axial length dimensions for mitigating low frequency dynamics within the combustion chamber;

a controller to vary flows of fuel into the plurality of annular micro-mixer nozzles, wherein a center micro-mixer nozzle of the plurality of annular micro-mixer nozzles receives a higher flow of fuel as compared to a flow of fuel into another one of the plurality of annular micro-mixer nozzles for increasing a fuel-air ratio in the center micro-mixer nozzle to a value that is comparable with a fuel-air ratio in the another one of the plurality of annular micro-mixer nozzles.

10. The system of claim 9, wherein the plurality of annular micro-mixer nozzles are configured to be mechanically staggered axially for mitigating low frequency axial mode dynamics in the combustion chamber.

* * * * *